US009879532B2

(12) United States Patent
Goellner

(10) Patent No.: US 9,879,532 B2
(45) Date of Patent: Jan. 30, 2018

(54) ADAPTATION OF A HYDRAULIC MOTOR

(71) Applicant: DANFOSS POWER SOLUTIONS GMBH & CO OHG, Neumunster (DE)

(72) Inventor: Wilhelm Goellner, Neumunster (DE)

(73) Assignee: DANFOSS POWER SOLUTIONS GMBH & CO OHG, Neumunster (DE)

( * ) Notice: Subject to any disclaimer, the term of this patent is extended or adjusted under 35 U.S.C. 154(b) by 364 days.

(21) Appl. No.: 14/722,362

(22) Filed: May 27, 2015

(65) Prior Publication Data

US 2015/0354355 A1 Dec. 10, 2015

(30) Foreign Application Priority Data

Jun. 5, 2014 (DE) ..... 10 2014 210 774

(51) Int. Cl.

| | |
|---|---|
| ***F01B 3/00*** | (2006.01) |
| ***F04B 23/02*** | (2006.01) |
| ***F04B 53/18*** | (2006.01) |
| ***F04B 1/24*** | (2006.01) |

(52) U.S. Cl.

CPC ..... *F01B 3/0023* (2013.01); *F01B 3/0005* (2013.01); *F01B 3/0044* (2013.01); *F04B 1/24* (2013.01); *F04B 23/028* (2013.01); *F04B 53/18* (2013.01)

(58) Field of Classification Search

CPC ..... F04B 1/122; F04B 23/026; F04B 23/028; F04B 53/18; F01B 3/0029; F01B 3/0032

USPC ..... 92/71

See application file for complete search history.

(56) References Cited

U.S. PATENT DOCUMENTS

| | | | | |
|---|---|---|---|---|
| 4,903,577 | A | 2/1990 | Loffler | |
| 8,528,594 | B2 * | 9/2013 | Gollner | F04B 53/18 60/455 |
| 2003/0017057 | A1 * | 1/2003 | Suzuki | F04B 1/128 417/206 |
| 2014/0328702 | A1 * | 11/2014 | Riediger | F04B 1/126 417/269 |
| 2015/0377233 | A1 * | 12/2015 | Rasch | F04B 53/18 417/269 |

FOREIGN PATENT DOCUMENTS

| | | | |
|---|---|---|---|
| CN | 201568242 | U | 9/2010 |
| CN | 102312805 | A | 1/2012 |
| CN | 102996387 | A | 3/2013 |
| DE | 4130225 | C1 | 11/1992 |

(Continued)

OTHER PUBLICATIONS

CN102996387A—English Abstract.

(Continued)

*Primary Examiner* — Michael Leslie
(74) *Attorney, Agent, or Firm* — Zarley Law Firm, P.L.C.

(57) ABSTRACT

The invention relates to a hydraulic axial piston machine (1) of dry case type of construction, whose case (2) is provided for connection to a gearing case (21) so as to form a fluid-tight overall case. The case (2) has openings (10) which permit the passage of leakage hydraulic fluid or of lubricant into the gearing case (21). By means of this design, splashing losses of the axial piston machine (1) are eliminated, and the leakage hydraulic fluid or the lubricant serve for the lubrication both of the axial piston machine (1) and of the gearing (20).

14 Claims, 2 Drawing Sheets

(56) References Cited

FOREIGN PATENT DOCUMENTS

| | | | |
|---|---|---|---|
| DE | 4128615 | C1 | 1/1993 |
| DE | 4215869 | C1 | 9/1993 |
| DE | 4235697 | A1 | 3/1994 |
| DE | 4414509 | C1 | 10/1995 |
| DE | 10 2011 014 589 | A1 | 9/2012 |
| JP | 2002031040 | A | 1/2002 |
| JP | 2004169654 | A | 6/2004 |

OTHER PUBLICATIONS

CN201568242U—English Abstract.
CN102312805A—English Abstract.
JP2004169654A—English Abstract.
JP2002031040A—English Abstract.
Chinese Office Action issued by the State Intellectual Property Office (SIPO) dated Dec. 20, 2016; Chinese Patent Application No. 201510299970.0; Danfoss Power Solutions.

* cited by examiner

ADAPTATION OF A HYDRAULIC MOTOR

BACKGROUND OF THE INVENTION

The invention relates to an adjustable hydraulic axial piston machine of dry case type of construction, as per claim 1.

A hydraulic axial piston machine of said type is known for example from DE 44 14 509 C1. It is stated in said document that, in the case of conventional hydraulic machines, the case is constantly filled with liquid owing to inevitable pressure fluid leakage. As drive assembly parts rotate in the liquid-filled case, energy losses occur, which are referred to as splashing losses. To reduce splashing losses, it is advantageous, in particular in the case of operation at high rotational speeds, for the liquid to be removed from the machine case in order that the drive assembly rotates in a case that has been emptied of oil. For the removal of liquid from the case, various methods have been proposed which are based on the extraction of the leakage liquid by suction. The type of construction of hydraulic axial piston machines realized in this way is referred to as the dry case type of construction. Such hydraulic axial piston machines with pump devices for the extraction of leakage fluid by suction are described for example in DE 44 14 509 C1, DE 42 15 869 C1 and DE 41 28 615 C1. The invention is based on an axial piston machine of said type.

DE 41 30 225 C1 furthermore describes a hydraulic axial piston machine for installation into a gearing casing, which axial piston machine has a machine case which is open on one side and which has a connection block which closes off said machine case. The connection block has a pressure duct and a suction duct for the pressure fluid. A drive shaft of the axial piston machine projects out of the case and the connection block into the gearing casing and is mounted in the machine case and in the connection block. Said document makes no mention of measures for removing leakage liquid or for supplying lubricant to the axial piston machine or to the gearing. Further hydromechanical drives which have an axial piston machine and a gearing integrated therein are described for example in DE 10 2011 014 589 A1 and DE 42 35 697 A1.

The invention is based on the object of specifying a hydraulic axial piston machine of dry case type of construction for installation into a case, for example into a gearing casing, with which a reliable supply of lubricant to the axial piston machine and to the gearing for connection thereto is ensured in a simple and inexpensive manner. It is a further object to provide a hydraulic drive which comprises an axial piston machine of said type and a gearing.

SUMMARY OF THE INVENTION

Said object is achieved according to claim 1 by means of a hydraulic axial piston machine of dry case type of construction, having a case for accommodating a drive assembly which can be adjusted by means of an adjustment device and which serves for delivering hydraulic liquid, and having a drive shaft which is operatively connected to the drive assembly and which is mounted in the case by means of bearings so as to be rotatable about its longitudinal axis, wherein neither the drive assembly, the drive shaft nor the bearings thereof run in a sump of the hydraulic liquid, and the case has openings, via which leakage hydraulic liquid and lubricant can flow out of the case, and a fastening flange, which is arranged, transversely with respect to the longitudinal axis of the drive shaft, between the adjustment device of the axial piston machine and the openings in the case.

The axial piston machine according to the invention is for example provided for being inserted into a case of a drive, wherein it is the intention that, after the insertion of the axial piston machine within a gearing case, the openings in the case come to lie such that the lubricant or leakage liquid flowing out of the axial piston machine can flow out into the gearing case. Here, said lubricant or leakage liquid serves for example for lubricating the gearwheels of the gearing. This may make it possible for a dedicated supply, independent of the axial piston machine, of lubricant to the gearing to be dispensed with, which reduces the outlay in terms of construction. The liquid lubricant or leakage fluid can be removed from the gearing case by being pumped out, and supplied to the pressure fluid circuit or to the sump of the gearing.

In one embodiment of the invention, it is preferable for the axial piston machine to be equipped with a first bearing region and a second bearing region, wherein the bearing regions are formed on the drive shaft for the purpose of accommodating rolling or plain bearings. The first bearing region is in this case arranged within the case of the axial piston machine, whereas the second bearing region may be situated either in the case of the axial piston machine or in a gearing case connected to the axial piston machine. On the drive shaft there is preferably arranged a drive input/output region for the purposes of driving or extracting power from the drive shaft. Said drive input/output region is preferably formed with a toothed profile and engages for example into gearwheels which are arranged in a gearing case to which the axial piston machine according to the invention can be connected.

In one possible embodiment of the axial piston machine according to the invention, the drive input/output region is arranged between the first bearing region and the second bearing region. The second bearing region may for example be assigned to a gearing case. In this case, a gearwheel of the gearing is for example arranged on the drive shaft, which gearwheel, in this embodiment of the invention, is mounted between the two bearing regions and serves for the input of drive into/output of drive from the gearing.

In an alternative embodiment of the axial piston machine, the second bearing region is arranged on the drive shaft between the first bearing region and the drive input/output region. A gearwheel arranged on the drive shaft is preferably situated on that end of the drive shaft which projects out of the case of the axial piston machine. In this design variant, it is possible for both the second bearing region and/or the drive input/output region to be arranged outside the case of the axial piston machine. In this case, only the first bearing region of the drive shaft is formed in the case of the axial piston machine, which leads to a compact and simple design of the axial piston machine according to the invention. Furthermore, seals, in particular shaft seals, are not required.

In a preferred embodiment of the axial piston machine according to the invention, it is the case that—in the installed state of the axial piston machine—the openings in the case are arranged at the lowest point of the case. It is ensured in this way that leakage hydraulic liquid and/or lubricant can flow out of the axial piston machine case into the gearing or into the gearing case under the action of gravity. It is self-evident that the openings should be dimensioned to be large enough that the outflow takes place at a high enough rate to maintain a substantially dry case for the drive assembly of the axial piston machine, in which there is no splashing of moving and rotating components of the axial piston machine.

The axial piston machine according to the invention has a fastening flange formed on the case, which fastening flange serves for the connection of the axial piston machine to the gearing case. The fastening flange should preferably be equipped with sealing means which ensure that a connection which is sealed in oil-tight fashion to the outside can be produced between the case of the axial piston machine and the gearing case. A passage of lubricant from the axial piston machine to the drive input/output region of the gearing is however not impeded by this.

In a further preferred embodiment of the axial piston machine, a tapered-roller bearing is provided at the first bearing region for the mounting of the drive shaft in the case of the axial piston machine. Optimum accommodation of axial and radial forces is ensured in this way. It is furthermore preferable for an inner ring of a rolling or plain bearing to be arranged on the second bearing region of the drive shaft. The second bearing is preferably in the form of a floating bearing, wherein a cylindrical-roller bearing is preferable owing to the longer service life in relation to a ball bearing.

For the supply of lubricant to the axial piston machine, lubricant ducts may be formed at least partially by a central bore arranged in the drive shaft and by transverse bores which intersect the central bore. Via said lubricant ducts, hydraulic fluid can be supplied in targeted fashion to those parts of the axial piston machine which move relative to one another and thus also to the gearing.

The invention also relates to a hydraulic drive having an axial piston machine according to the invention and having a gearing with a gearing case onto which the case of the axial piston machine is flange-mounted such that the two cases together surround an interior space which is sealed in preferably fluid-tight fashion to the outside. A gearwheel of the gearing engages into the drive input/output region of the drive shaft of the axial piston machine. The openings in the case of the axial piston machine are arranged such that leakage hydraulic liquid and/or lubricant can flow into the gearing case.

The hydraulic drive having an axial piston machine according to the invention is preferably designed such that, in the gearing case, there is provided a bearing receiving region for accommodating the second bearing region of the drive shaft of the axial piston machine. In this case, a cylindrical-roller bearing in particular is suitable as a floating bearing if, in the first bearing region of the drive shaft, there is provided a tapered-roller bearing which accommodates the axial forces.

The gearing case of the hydraulic drive according to the invention is preferably equipped with pump means by which the leakage fluid and/or lubricant running out of the axial piston machine into the gearing is discharged and supplied into a common sump. From there, said liquid can be supplied again for lubrication of the hydraulic drive. The pump means may be in the form of a mechanical pump or may be realized by compressed air which displaces the liquid out of the gearing case into the sump or tank.

A particular advantage of the axial piston machine according to the invention lies in the fact that the hydraulic motor can be tested separately, that is to say for example before installation into a gearing case. In the case of an embodiment in which the second bearing region of the drive shaft is assigned to the gearing case, a second bearing region must then be provided in the test setup.

By means of the design of the axial piston machine according to the invention, it is possible to dispense with dedicated shaft or motor seals, resulting in lower costs. Only one common "dry" case is provided, as leakage fluid and/or lubricant can flow out, via large openings in the case of the axial piston machine, into the case in which the axial piston machine according to the invention is operated. Furthermore, only one oil has to be provided as hydraulic fluid and as lubricant for the hydraulic motor and the gearing.

The invention results in a particularly compact and simple design for the axial piston machine according to the invention and for a hydraulic drive in which the axial piston machine according to the invention is used. If the second bearing region is arranged in the gearing case, the resulting large bearing base or bearing spacing makes it possible to use smaller bearings. This, too, has a favourable effect on costs.

The invention will be explained in more detail below on the basis of exemplary embodiments that are illustrated in the figures, in which:

DETAILED DESCRIPTION OF THE PREFERRED EMBODIMENTS

Figure 1:
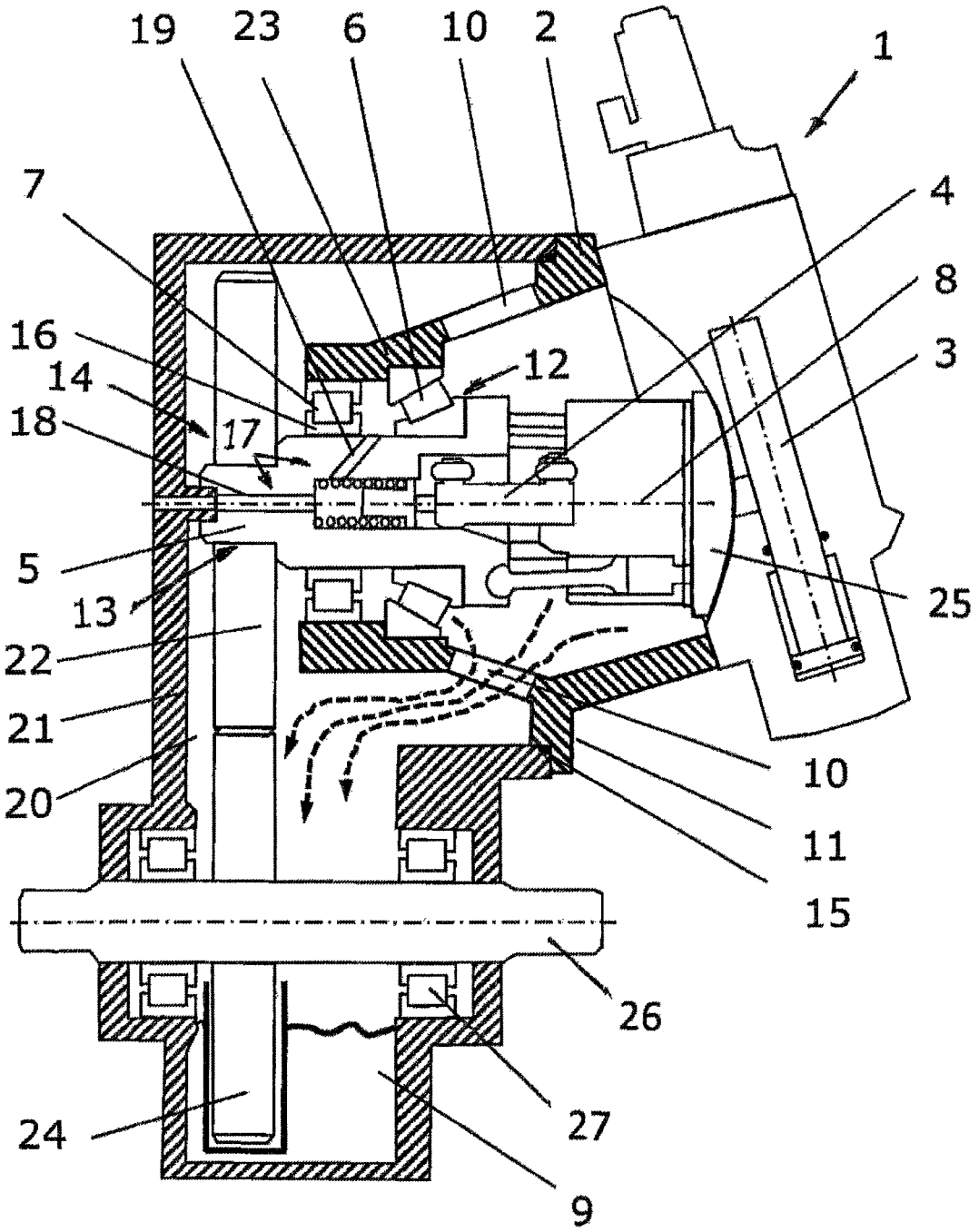
FIG. 1 shows a cross section through an axial piston machine of dry case type of construction according to the invention.

FIG. 1 illustrates a cross section through a hydraulic axial piston machine 1 of dry case type of construction according to the invention in a first embodiment. The axial piston machine 1 is in this case shown, by way of example, as an adjustable motor or pump of oblique axis type of construction, which has, in a case 2, a drive assembly 4, the valve segment 25 of which is engaged on by an adjustment device 3. The basic design and mode of operation of an axial piston machine 1 of said type are familiar to a person skilled in the art, such that no further explanations will be given in this regard.

The drive assembly 4 has a drive shaft 5 which is mounted, in a first bearing region 12 and a second bearing region 13, in a respective bearing 6, 7. The bearing 6 in the first bearing region 12 is in this case in the form of a tapered-roller bearing, whereas the bearing 7 in the second bearing region 13 is shown as a rolling bearing with an inner ring 16. The longitudinal axis of the drive assembly 4 is defined by the longitudinal axis 8 of the drive shaft. The drive shaft 5 is equipped with a central bore 18 in the direction of its longitudinal axis 8, from which central bore a transverse bore 19 branches off. Via said lubricant ducts 17 which are shown by way of example, hydraulic fluid and/or lubricant can be supplied from the outside to the axial piston machine 1. In an embodiment of the invention, it is particularly preferable here if the same hydraulic fluid is used both for the operation of the axial piston machine and for the lubrication of the axial piston machine 1 and of the downstream gearing 20.

On the front end of the drive shaft 5, which projects out of the case 2 as per FIG. 1, there is arranged a gearwheel 22 which meshes with a gearwheel 24 of a gearing 20. The position of the gearwheels 22 and 24 defines the drive input/output region 14 of the axial piston machine 1, which in this case is situated in an end region of the drive shaft 5 and thus outside the first and second bearing regions 12, 13. In this embodiment, the drive shaft 5 is mounted only in the case 2 of the axial piston machine 1, but not in the gearing case 21 of the gearing 20.

The case 2 of the axial piston machine 1 is connected by way of its fastening flange 11 to the gearing case 21, wherein in particular, an overall case which is sealed in fluid-tight fashion to the outside is formed by way of sealing means 15 arranged between the two cases 2, 21. The connection of the two cases 2, 21 is realized by way of a screw connection not shown in FIGS. 1 and 2. As a sealing means, use may for example be made of O-rings or of flat seals adapted to the shape of the fastening flange.

According to the invention, the case 2 has at least one opening 10 which, in the installed position of the axial piston machine 1, is situated in the gearing case 21 in the interior of the overall case spanned by both cases. Said opening or the openings 10 permit the passage of leakage hydraulic liquid or lubricant from the interior of the axial piston machine 1 into the gearing case 21. For this purpose, it is expedient if at least one of the openings 10 is, in the installed position, situated in the lowest region of the case 2, as shown in FIG. 1. It is self-evident that, in the case of some other position of the openings 10 in the case 2, fluid can pass from the interior of the case 2 into the gearing case 21 as the moving parts of the drive assembly 4 effect turbulence or atomization of leakage fluid or lubricant, which can pass through the openings 10 into the gearing case 21.

The gearing 20 shown in an exemplary structural form in FIG. 1 has a gearwheel 24 which is arranged on a shaft 26 which is mounted on the gearing case 21 by means of bearings 27. The shaft 26 may serve as a drive input or output shaft for a drive or a consumer, wherein it is self-evident that further components such as further gearwheels or clutches may be provided. In one embodiment of the invention, it is self-evidently also possible for the gearing 20 to be in the form of a planetary gear set.

The lowest region of the gearing case 21 in the installed position of the axial piston machine 1 with the gearing 20 is provided as a sump 9 for lubricating and leakage fluid. Said fluid originates from different regions of the drive assembly 4 and enters the gearing 20 from the axial piston machine 1 via the openings 10 in the case 2. In the gearing, said fluid serves for the lubrication of the gearing 20, whereupon it collects in the sump 9. This is indicated in FIG. 1 by the dashed arrows. From the sump 9, the lubricating and leakage fluid that has flowed in is removed by pump means (not shown here) and conducted into a tank and/or supplied again to the lubricant ducts 17 of the axial piston machine 1.

Figure 2:
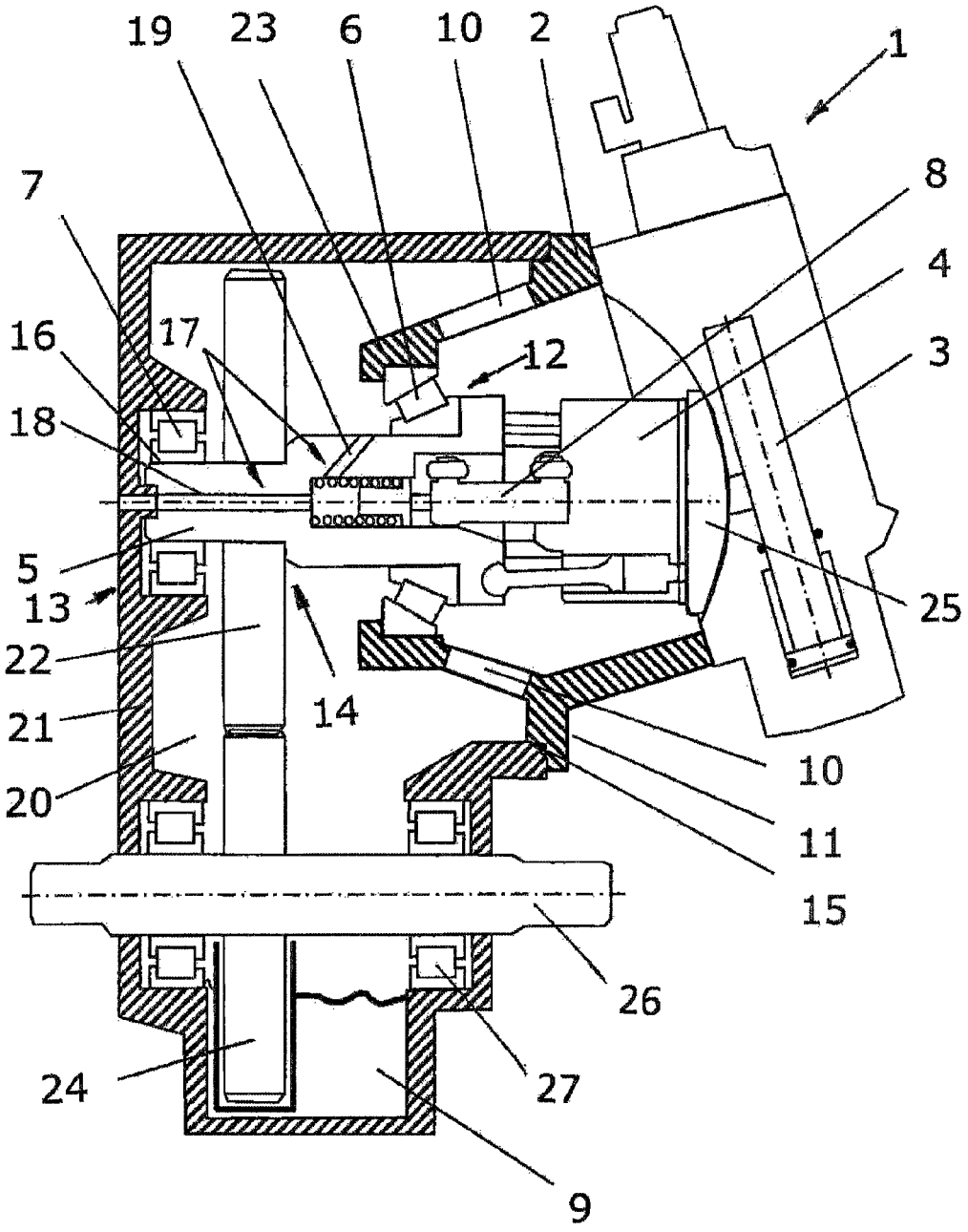
FIG. 2 shows a cross section through an axial piston machine of dry case type of construction according to the invention in a further embodiment.

FIG. 2 shows a modified exemplary embodiment of an axial piston machine 1 according to the invention in cross section. All of the reference signs used in FIG. 1 are also used in FIG. 2 to designate the same structural features.

The exemplary embodiment as per FIG. 2 differs from that as per FIG. 1 merely in that the drive input/output region 14 is arranged between the first bearing region 12 and the second bearing region 13 of the drive shaft 5. The bearing 7 of the drive shaft 5 is, for this purpose, arranged in the gearing case 21. Said bearing 7 is thus situated outside the case 2 of the axial piston machine 1 and is not assigned to said case. Accordingly, the case 2 of the axial piston machine has only one bearing 6 for the drive shaft 5, which bearing is shown in this case as a tapered-roller bearing, and thus in a preferred type of construction.

The second bearing 7 in the gearing case 21 receives a bearing region 13 of the drive shaft 5 of the axial piston machine 1 in a bearing receiving region 23. Accordingly, on said bearing region 13, there is arranged an inner ring 16 of a floating bearing whose outer ring is held in a bearing shell of the gearing case 21.

The mode of operation and the further details of this exemplary embodiment correspond fully to those of FIG. 1, such that the explanations given in this regard apply in this case also.

With the type of construction of the axial piston machine 1 according to the exemplary embodiment illustrated in FIG. 1, it is possible for the axial piston machine 1, for example for testing purposes, to be operated on its own, that is to say without being installed into a gearing case; all the parts necessary for this are arranged in or on the case 2. In particular, both of the bearings 6, 7 of the drive shaft 5, such as are required for operation, are already present. In the exemplary embodiment of FIG. 2, only one bearing 6 of the drive shaft 5 is provided in the case 2 of the axial piston machine 1. Since the second bearing 7 is provided by the gearing case 21, it is necessary, for the operation of the axial piston machine 1 without the gearing case 21, to use an apparatus which provides a second bearing receptacle 7.

What is claimed:

1. Hydraulic axial piston machine (1) of dry case type of construction, having a case (2) for accommodating a drive assembly (4) which can be adjusted by means of an adjustment device (3) and which serves for delivering hydraulic liquid, and having a drive shaft (5) which is operatively connected to the drive assembly (4) and which is mounted in the case (2) by means of bearings (6, 7) so as to be rotatable about its longitudinal axis (8), wherein neither the drive assembly (4), the drive shaft (5) nor the bearings (6, 7) thereof run in a sump (9) of the hydraulic liquid, and the case (2) has openings (10), via which leakage hydraulic liquid and lubricant can flow out of the case (2), and a fastening flange (11), which is arranged, transversely with respect to the longitudinal axis (8) of the drive shaft (5), between the adjustment device (3) of the axial piston machine (1) and the openings (10) in the case (2).

2. Axial piston machine according to claim 1, having a first bearing region (12) and a second bearing region (13) which are provided on the drive shaft (5) for the purpose of accommodating rolling or plain bearings, and having a drive input/output region (14) which is arranged on the drive shaft (5), for the purposes of driving or extracting power from the drive shaft (5), wherein the first bearing region (12) is arranged within the case (2).

3. Axial piston machine according to claim 2, in which the drive input/output region (14) is arranged between the first bearing region (12) and the second bearing region (13).

4. Axial piston machine according to claim 2, in which the second bearing region (13) is arranged between the first bearing region (12) and the drive input/output region (14).

5. Axial piston machine according to claim 2, in which the second bearing region (13) and/or the drive input/output region (14) are arranged outside the case (2).

6. Axial piston machine according to claim 1, in which, in the installed state of the axial piston machine (1), the openings (10) in the case (2) are arranged at the lowest point of the case (2).

7. Axial piston machine according claim 1, in which the fastening flange (11) is equipped with sealing means (15).

8. Axial piston machine according to claim 2, in which a tapered-roller bearing is provided at the first bearing region (12) for the mounting of the drive shaft (5) in the case (2) of the axial piston machine (1).

9. Axial piston machine according to claim 2, in which an inner ring (16) of a rolling or plain bearing is arranged in the second bearing region (13) of the drive shaft (5).

10. Axial piston machine according to claim 1, in which lubricant ducts (17) are formed at least partially by a central bore (18) arranged in the drive shaft (5) and by transverse bores (19) which intersect the central bore (18).

11. Hydraulic drive having an axial piston machine (1) according to claim 1 and having a gearing (20) with a gearing case (21) onto which the case (2) of the axial piston machine (1) is flange-mounted such that the two cases (2, 21) together surround an interior space which is sealed in fluid-tight fashion to the outside, a gearwheel (22) of the gearing (20) engages into the drive input/output region (14) of the drive shaft (5) of the axial piston machine (1), and the openings (10) in the case (2) of the axial piston machine (1) are arranged such that leakage hydraulic liquid and/or lubricant can flow into the gearing case (21).

12. Hydraulic drive having an axial piston machine (1) according to claim 1, in which, in a gearing case (21), there is provided a bearing receiving region (23) for accommodating a second bearing region (13) of the drive shaft (5) of the axial piston machine (1).

13. Hydraulic drive according to claim 12, in which a floating bearing for the mounting of the drive shaft (5) is designed for receiving the second bearing region (13).

14. Hydraulic drive according to claim 11, characterized in that pump means are provided for removing leakage hydraulic liquid and/or lubricant from the gearing case (21).

* * * * *